United States Patent [19]

Teichert

[11] 4,223,291

[45] Sep. 16, 1980

[54] CONVERTIBLE SET-BACK SELECTOR CLIP

[75] Inventor: Allen L. Teichert, Placentia, Calif.

[73] Assignee: Robertshaw Controls Company, Richmond, Va.

[21] Appl. No.: 938,393

[22] Filed: Aug. 31, 1978

[51] Int. Cl.[2] ..... H01H 37/02

[52] U.S. Cl. ..... 337/303; 236/46 R; 337/305

[58] Field of Search ..... 337/301-305; 236/46 R, 47

[56] References Cited

U.S. PATENT DOCUMENTS

| | | | |
|---|---|---|---|
| 3,834,618 | 9/1974 | Buckwalter | 337/304 X |
| 4,045,760 | 8/1972 | Marquis et al. | 337/301 |
| 4,129,847 | 12/1978 | Teichert | 337/301 |

*Primary Examiner*—R. L. Moses

*Attorney, Agent, or Firm*—Fulwider, Patton, Rieber, Lee & Utecht

[57] ABSTRACT

There is disclosed a timer mechanism having a driven clock dial with a mechanism for sequential operational modes activated by arms which are adjustably fixedly carried on the clock dial. The invention comprises a bracket fixedly carried on the clock dial which receives a removeable arm clip permitting the clip to be removed and the arm deactivated. The device is particularly intended for use with room or space heating thermostats and the removeable clip permits conversion of the thermostat from single to multile set-back capability.

8 Claims, 5 Drawing Figures

CONVERTIBLE SET-BACK SELECTOR CLIP

BACKGROUND OF THE INVENTION

1. Field of Invention

This invention relates to a timer mechanism and, in particular, to a timer mechanism useful for controlling set-back intervals of preselected control temperatures for the thermostat.

2. Brief Description of the Prior Art

Space heating thermostats such as the typical wall mounted thermostats used in rooms of buildings have, in recent years, been provided with set-back capability. An example of a thermostat of this nature is that shown in U.S. Pat. No. 3,948,441 which includes a battery driven clock mechanism which is functional to change the preselected control temperature between preselected control temperatures at preselected periods during a day.

One of the difficulties associated with the aforementioned timer control thermostat is that many applications require multiple set-backs of the control temperature. As, for example, a working couple are away from their dwelling for extended daytime periods. The thermostat for this application desirably should provide for the automatic set-back of the control temperature during night hours when the occupants are asleep and also during day hours when the occupants are at work.

The timer mechanisms typically have 24-hour dials so that the set-back point can be selected once in every twenty-four period. It is desirable in such a mechanism to provide the capability for yet another set-back period and further desirable that such set-back period can be cancelled so that a single thermostat model can be employed, interchangeably, for single and dual set-back periods.

BRIEF STATEMENT OF THE INVENTION

This invention comprises a timer mechanism which employs a convertible means for effecting movement of a cam driven mechanism. The mechanism in the particular embodiment comprises a rocker-mounted thermostatic switch that is responsive to cam means for movement between preselected positions. The cam means is mounted on the thermostat in juxtaposition to the clock driven dial. A plurality of arms are fixedly adjustably carried on the dial. The dial also carries at least one fixedly adjustable flange and a removable arm clip is provided having a clamp to receive the flange and permit its removeable attachment to the bracket. The arms engage levers carried by the juxtapositioned cam to effect rotational movement of the cam which, in turn, bears against the rocker-mounted thermostatic switch to effect rocking of the switch between the peselected positions. The preferred thermostatic switch comprises a magnetic switch and the cam is effective to change the relative positions of the switch to the magnet, the latter being carried on a thermostatic, bimetallic member for movement into and out of proximity to the switch housing in response to temperature changes.

BRIEF DESCRIPTION OF THE FIGURES

The invention will be described with reference to the figures of which.

DESCRIPTION OF PREFERRED EMBODIMENT

Figure 1:
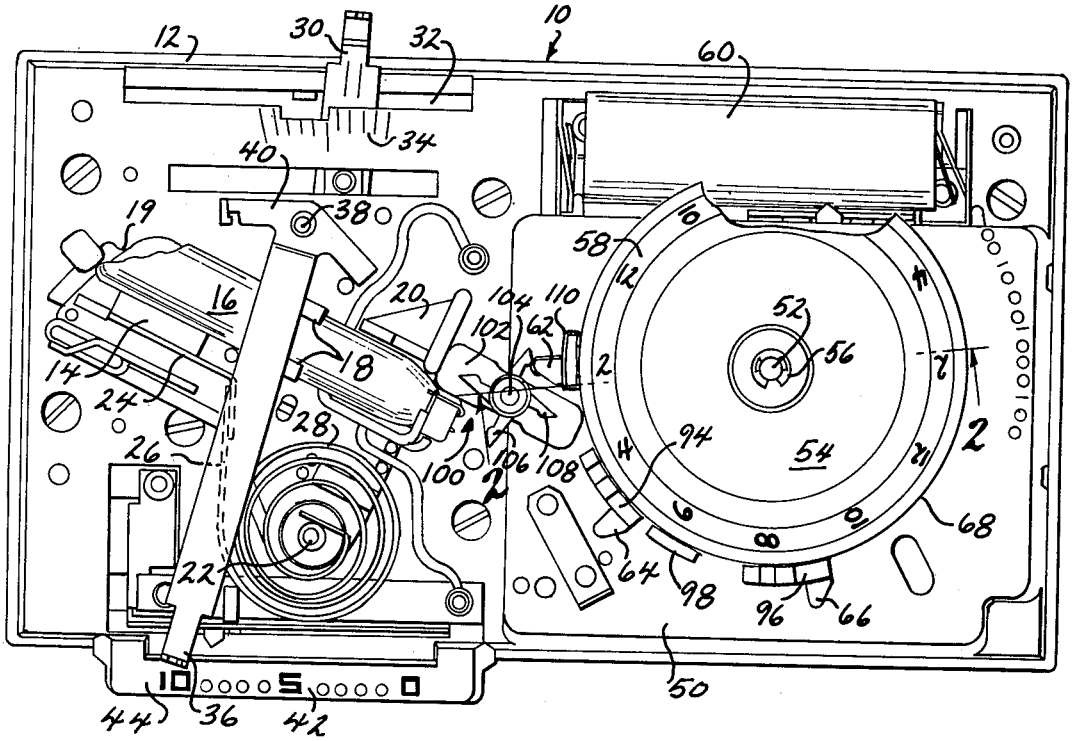
FIG. 1 is a full front view of a room thermostat modified to include the present invention.

Referring now to FIG. 1, the invention is shown as applied to permit conversion of a timer mechanism to dual set-back operation of a room thermostat generally designated at 10 which is contained in a generally rectangular housing 12 surfaced with a cover plate, not shown. In this application, the mechanism for sequential operational modes is a thermostatic switch that is contained within a tube 16 and carried by brackets 18 on a rocker bracket 20 which is pivotally mounted on pin 22. The bracket 20 is biased in a clockwise direction, in the illustrated view, by resilient coil spring means, not shown. The switch of the thermostat is, preferably, a magnetically activated switch and the assembly includes a permanent magnet 14 which is distally carried on the end 24 of the thermostatic coil 28. The latter is a helical coil of bimetallic construction having the known characteristic of expansion and contraction in response to relatively minor changes in ambient temperatures. The coil 28 is also mounted on pin 22. In accordance with known constructions, the helical bimetallic coil 28 is fixedly secured to the pin 22 and this pin is secured to lever 30 whereby movement of lever 30 effects rotation of the helical bimetallic coil. The movement of lever 30 effects a fixedly adjustable and variable spacing of magnet 24 relative to the magnetic switch in tube 16 and thereby effects a controlled variation in the degree of expansion or contraction of helical coil 28 to effect opening and closing of the contacts of the switch. The lever 30 projects through a slot 32 on the rear wall of housing 12. Indicia 34, in the form of a plurality of calibrated markings, are also provided to indicate the position of lever 30. The indicia are visible through the face plate of the housing to permit the user to preselect the set-point or control temperature of the thermostat.

As previously mentioned, the thermostat of the invention has provision for a set back of the preselected temperature indicated by indicia 42. The set-back adjustment is of a variable, controlled magnitude by the adjustment means comprising lever 36 that is pivotally mounted on pin 38 and that comprises an arm 40 which projects into contact with the edge 19 of rocker bracket 20, whereby the rotational movement of lever 36 effects a controlled variation in the angular position of the switch tube 16 in the assembly. Lever 36 is also provided with indicia 42 which are carried on flange 44 that projects below the face of the cover plate and are, therefore, visible externally of the housing 12. The indicia are preferably provided in 1° increments from 0° to 10° whereby the magnitude of the set-back can be varied from 1° to 10° F.

The timer mechanism employed in the thermostat comprises a clock mechanism carried within housing 50 which has an output shaft 52 that is rotated on a 24-hour operation, i.e., on revolution per 24 hours. A timer or clock dial 54 is fixedly mounted to shaft and retained by suitable means such as the retainer clip 56. This dial is calibrated with indicia 58 to indicate the time of day. The timer motor is driven by a power supply such as a rechargeable storage battery 60 in the manner disclosed in the aforesaid U.S. Pat. No. 3,948,411.

Also mounted on shaft 52 is a plurality of lugs which are fixedly adjustably secured to the clock dial The lugs are shown as elements 62, 64 and 66 which project radially from the peripheral edge 68 of the dial 54.

Figure 2:
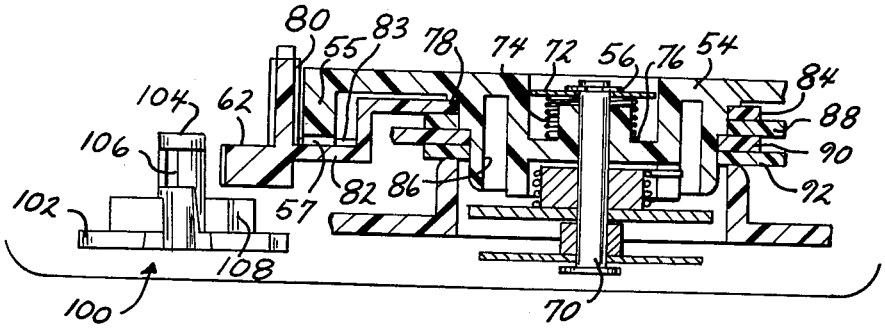
FIG. 2 is a view along line 2—2 of FIG. 1.

Referring now to FIG. 2, the assembly of the plurality of lugs and clock dial will be described in greater detail. As shown in FIG. 2, dial 54 is mounted on shaft 70 with the retainer clip 56. Clip 56 retains a washer 72 which secures a helical coil spring 74 that is biased against the bottom of annular groove 76 in the face of dial 54. The undersurface of dial 54 has a annular shoulder 78 which bears against a stacked array of radial arms. As shown in FIG. 2, the lug 62 is a integral projection of the flange 80 which is carried on the radial arm 82 that extends to a center section having an annular rim 84 that encircles the hub 86 of the dial 54. Four such annular rims, 84, 88, 90 and 92 are provided, each bearing a radial arm such as arm 82. As shown in FIG. 1, the radial arms support flange 94 and integral lug 64, flange 96 and integral lug 66 and flange 98, the latter not being provided with a lug.

The dial 54 has a peripheral skirt or axial rim 55 which has a plurality of evenly spaced radial notches 57 and each of the arms such as 82 has a coacting radial rib 83 to fixedly secure the angular position of the arm.

Referring now to FIG. 1, the timer mechanism alos includes cam means generally indicated at 100 and comprising a rectangulr cam 102 that is pivotally mounted on shaft 104 and that is fixedly secured to two pair of complimentary levers 106 and 108. As shown in FIG. 2, the first pair of complimentary levers 106 are at different axial positions, to lie in a different plane than the complimentary levers 108, the arms in each pair of complimentary levers being at 180° angular spacings. The radial lug 62 is carried by its supporting arm 82 in the plane of the complimentary levers 106 and, hence, is effective in rotating the cam to the position illustrated in FIG. 1 where the cam 102 bears against bracket 20 and rocks the thermostatic switch assembly away from its engagement with arm 40 of the set-back assembly arm 36.

The fixedly adjustable lug 64 carried on flange 94 is in the same plane as the complimentary levers 108 and is effective to engage these levers upon continued rotation of the dial and rotate the cam 102 to permit the thermostatic switch assembly to return into engagement with arm 40. This operaion is illustrated in FIG. 3 where the lug 64 is shown in engagement against one of the pair of complimentary levers 108, retracting cam 102 from the cam guide of bracket member 20, releasing this bracket with the thermostatic switch and tube 16 to bear against arm 40 of the set-back adjustment arm 36.

The illustration in FIG. 1 shows the thermostat device for its normal control or set point as determined by the position of lever 30 which is set at a comfortable value by the dwelling occupants. In this position, the magnet 24 has moved into contact with the switch tube 16, closing the contacts of the switch contained therein and establishing a heating cycle.

Figure 3:
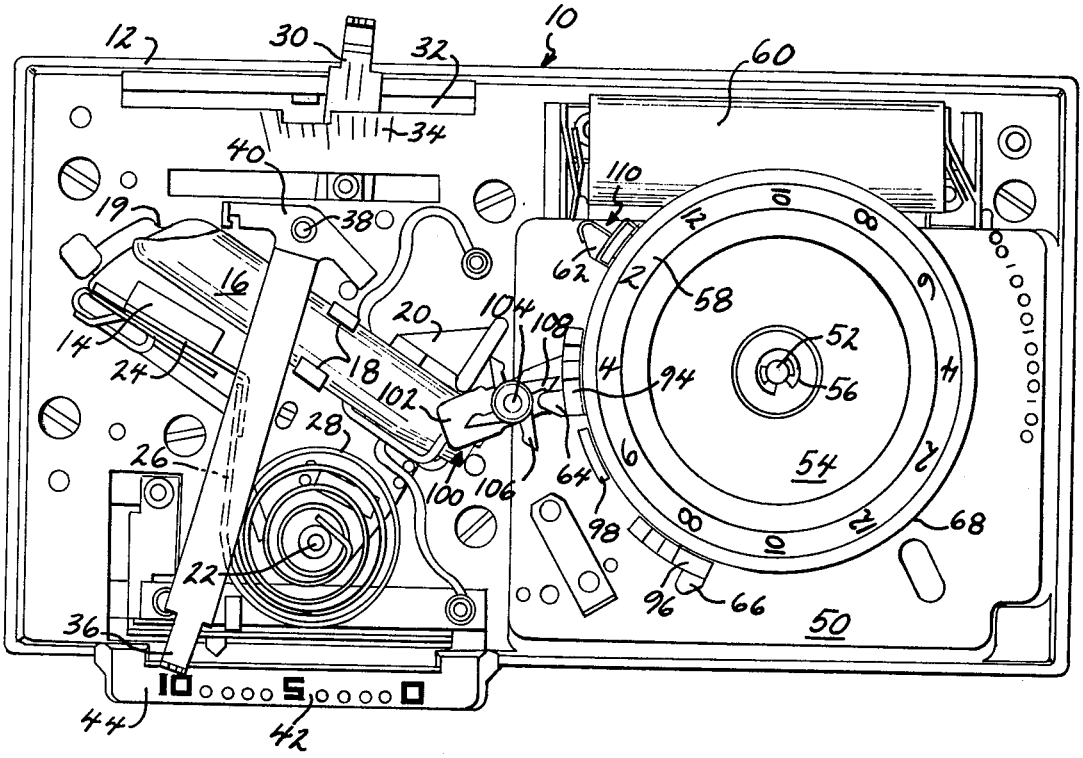
FIG. 3 is a front view of the thermostat showing an operational mode of the timer mechanism.

In FIG. 3, the same conditions are illustrated, i.e., the identical position for the normal set-point temperature and the same temperature sensed by the thermostatic coil 28. The rocker arm which supports the thermostatic assembly 14, however, has been released by rotating of cam 102 away from the cam guide and bracket 20 and this movement separates the magnet 24 from the tube 16, maintaining the normally open contacts of the switch therein in an open state with no heating demand signal. A heating demand at this temperature can only be generated by further clockwise rotation of the arm 26 of the bimetallic coil 28 and the degree of this movement for effecting closure of the switch contacts depends entirely on the angular position of the tube 16. The angular position of tube 16 is controlled by the position of the rocker bracket 20 on which it is mounted which, in turn, is adjusted by arm 36 that moves lever 40 to provide a fixed adjustability in the abuttment of lever 40 against the rocker arm of the switch assembly.

Figure 5:
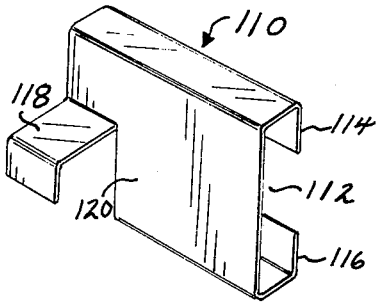
FIG. 5 illustrates the clip.
Figure 4:
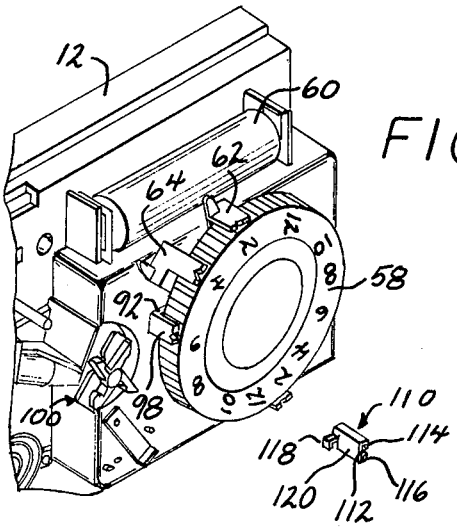
FIG. 4 illustrates employment of the removeable clip of the invention.

As previously mentioned, this invention comprises a simple adjustment means for the provision of a second set-back interval in the aforedescribed timer mechanism. Referring now to FIGS. 4 and 5, there is illustrated the means of the invention which permits conversion of the timer mechanism to a dual set-back operation. As there illustrated, flange 98 is carried on a radial arm 92. Arm 92 as the other arms such as 82, shown in FIG. 2, is fixedly adjustably secured about the periphery of the dial 54. Clip 110 is removably mounted on flange 98 and, for this purpose, has a receptable groove 112 that is received over the flange 98. Clip 110 is a bent metal clip having longitudinal reverse bends 114 and 116 and an arm 118 which projects from the front face 120 of the clip. Arm 118 projects from face 120 a sufficient distance to engage the complimentary pair of levers 106 in the manner shown in FIG. 1.

The preferred form of clip 110 permits the clip to be also received over the lug 62 and, the clip is illustrated in this position in FIG. 1. This permits storing of clip 110 on the lug 62 when the timer device is in the single set-back mode and readily permits conversion to a dual set-back mode by removing the clip 110 from lug 62 and placing the clip over flange 98 in the manner illustrated in FIG. 4.

The invention as thus described is a very convenient and simple timer mechanism having the convertibility to effect at least two changes in the operational mode of the thermostat switch during a single rotation of the timer dial which is geared to rotate once every 24 hours. Accordingly, the device can be used to effect one or two changes in the set point temperature during a single 24-hour period.

The invention has been described with reference to the illustrated and presently preferred embodiment. It is not intended that the invention be duly limited by this description of preferred embodiments. Instead, it is intended that the invention be defined by the means and their obvious equivalents, set forth in the following claims.

What is claimed is:

1. In a timer mechanism having a driven clock dial, a mechanism for sequential operational modes, juxtapositioned cam means operative, upon movement, to move said mechanism to a preselected operational mode, and at least one radial arm fixedly adjustably secured to said clock dial and bearing a respective lug to engage and move said cam means, the improvement comprising: at least one flange secured to said dial and a removeable arm clip having a receptacle groove to receive said flange and permit its removeable mounting on said flange in a position with its arm projecting radially from said dial a sufficient distance for operative engagement with said cam means.

2. The timer mechanism of claim 1 wherein said clock dial carries at least two arms fixedly adjustably secured to said clock dial.

3. The timer mechanism of claim 1 wherein said flange is fixedly adjustably secured to said clock dial.

4. The timer mechanism of claim 1 wherein said cam means comprises a rotational cam bearing at least one pair of complementary levers, positioned at different angular and axial positions and wherein said arm means comprises at least one pair of complementary arm means, one each at the same axial position as a respective one of said levers for engagement therewith.

5. The timer mechanism of claim 4 wherein said cam means bears two pair of said levers, said levers positioned at 90 degree angular spacings and at alternate axial spacings.

6. The timer mechanism of claim 5 wherein at least one of said arms has a flange to receive said clip and provide storage retention of said clip.

7. The timer mechanism of claim 1 in combination with a space thermostat wherein said mechanism for sequential operational modes is a magnetically responsive switch mounted on a rocker bracket and said cam means is operative to engage said lever and rock said rocker bracket and switch between positions towards and away from magnet means distally carried by a thermostatically responsive member.

8. The timer mechanism of claim 7 wherein said thermostatically responsive member is a bimetallic helical coil.

* * * * *